United States Patent [19]

Gregory et al.

[11] Patent Number: 4,971,875

[45] Date of Patent: Nov. 20, 1990

[54] MULTILAYER ORGANIC PHOTOCONDUCTOR

[75] Inventors: Peter Gregory, Bolton; Prahalad M. Mistry, Tameside, both of England

[73] Assignee: Imperial Chemical Industries Plc, London, England

[21] Appl. No.: 347,010

[22] Filed: May 4, 1989

[30] Foreign Application Priority Data

May 6, 1988 [GB] United Kingdom ..... 8810688

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 4,315,981 | 2/1982 | Wiedemann | 430/59 |
| 4,330,608 | 5/1982 | Limburg et al. | 430/59 |
| 4,855,202 | 8/1989 | Yoshihara et al. | 430/58 |

FOREIGN PATENT DOCUMENTS

| | | | |
|---|---|---|---|
| 63-257762 | 10/1988 | Japan | 430/58 |

*Primary Examiner*—Roland E. Martin

*Attorney, Agent, or Firm*—Cushman, Darby & Cushman

[57] ABSTRACT

An organic photoconductor comprising an electrically conducting support, a charge generation layer containing dibromoanthanthrone and a charge transport layer containing a di- or triarylmethane compound of the formula:

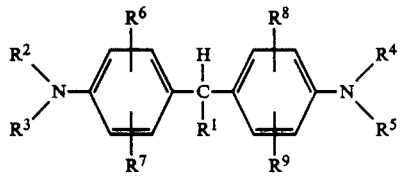

(1)

wherein $R^1$ represents hydrogen or an optionally substituted alkyl, alkenyl, cycloalkyl, cycloalkenyl, aralkyl or aryl radical;

each of $R^2$, $R^3$, $R^4$ and $R^5$, independently, represent hydrogen or an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, represents a hydrogen or halogen atom or a hydroxy, alkyl or alkoxy group; and a hydrazone compound of the formula:

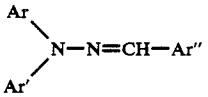

(2)

wherein each of Ar, Ar′ and Ar″, independently represents a phenyl or naphthyl radical, each of which may optionally carry one or more non-ionic substituents.

4 Claims, No Drawings

MULTILAYER ORGANIC PHOTOCONDUCTOR

This invention relates to an organic photoconductor for use as the photosensitive element of an electrophotographic device such as a copier or printer.

Organic photoconductor (OPC) or photoreceptor devices used in electrophotographic copiers and printers generally comprise an electrically conducting support, a charge generation layer (CGL) and a charge transport layer (CTL). The conductive support is typically an aluminium drum or an aluminised polyester film. The charge generation layer contains a charge generating material (CGM), which is usually a pigment, and a binder resin which is typically a polycarbonate. The charge transport layer contains a charge transport material (CTM), which is usually a colourless, electron-rich organic molecule having a low ionisation potential and a binder resin, usually a polycarbonate.

The charge generation layer, commonly having a thickness of from 0.1 to 3 μm, is usually bonded to the conductive support by means of a thin layer of adhesive (about 0.1 μm), the charge transfer layer (about 15 μm) overlying the charge generation layer.

For effective performance, both the CGM and the CTM must be of very high purity.

Dibromoanthanthrone is a known CGM and its use in conjunction with a leuco di- or triarylmethane as CTM has been described in DE-A-2929518. The OPC based on this combination has good charge acceptance and dark decay characteristics but the sensitivity, a key parameter, is only average (7.5 lux-sec). A combination of dibromoanthanthrone as CGM with a hydrazone as CTM has been disclosed in Japanese Patent Publication No. 61-182047, the combination providing an OPC having good sensitivity (2.5 lux-sec) but poor charge acceptance and dark decay.

It has now been found that when dibromoanthanthrone as CGM is used in conjunction with a CTM comprising a mixture of a leuco di- or triarylmethane and a hydrazone, an OPC is obtained having good charge acceptance, good dark decay and good sensitivity. This is a completely unexpected result since the addition of a second CTM to a first CTM can be regarded as equivalent to adding an impurity which generally produces a deterioration in OPC performance.

Accordingly, the invention provides an organic photoconductor comprising an electrically conducting support, a charge generation layer containing dibromoanthanthrone and a charge transport layer containing a di- or triarylmethane compound of the formula:

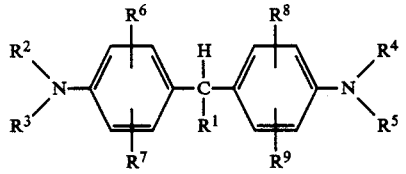

(1)

wherein $R^1$ represents hydrogen or an optionally substituted alkyl, alkenyl, cycloalkyl, cycloalkenyl, aralkyl or aryl radical;

each of $R^2$, $R^3$, $R^4$ and $R^5$, independently, represents hydrogen or an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, represents a hydrogen or halogen atom or a hydroxy, alkyl or alkoxy group;

and a hydrazone compound of the formula:

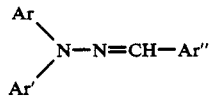

(2)

wherein each of Ar, Ar' and Ar'', independently represents a phenyl or naphthyl radical, each of which may optionally carry one or more non-ionic substituents.

Halogen atoms which may be present as substituents in the compounds of Formula 1 particularly include chlorine and bromine atoms.

Alkyl and alkoxy radicals which may be present in the compounds of Formula 1 preferably contain from 1 to 4 carbon atoms. Substituents which may be present on such radicals include halogen atoms and hydroxy and alkoxy groups.

Alkenyl radicals which may be present in the compounds of Formula 1 preferably have from 2 to 4 carbon atoms and cycloalkenyl radicals preferably have from 5 to 7 carbon atoms.

Cycloalkyl radicals which may be present in the compounds of Formula 1 preferably contain from 5 to 7 carbon atoms, for example cyclohexyl.

Aralkyl radicals which may be present in the compounds of Formula 1 particularly include phenylalkyl radicals such as benzyl and phenylethyl.

Aryl radicals which may be present in the compounds of Formula 1 particularly include phenyl radicals.

Heterocyclic rings which may be present in the compounds of Formula 1 due to $R^2$ and $R^3$ and/or $R^4$ and $R^5$ being joined together typically contain from 5 to 7 atoms. Examples of such rings include pyrrolidine, piperidine and morpholine rings.

As a specific example of a compound of Formula 1, there may be mentioned the compound in which $R^1$ is phenyl, each of $R^2$–$R^5$ is ethyl, each of $R^6$ and $R^8$ is methyl and is ortho to the central carbon atom and each of $R^7$ and $R^9$ is hydrogen.

In preferred hydrazones of Formula 2, Ar is phenyl, Ar' is phenyl or 1- or 2-naphthyl and Ar'' is either 1- or 2-naphthyl or a 4-aminophenyl radical wherein the amino group is preferably secondary or, especially, a tertiary amino group having alkyl, aralkyl or aryl substituents.

Preferably, the charge transport layer contains a mixture of from 50 to 95% by weight of compound of Formula 1 and from 50 to 5% by weight of compound of Formula 2.

The electrically conducting support may be a metal support preferably in the form of a drum or a composite material comprising an insulating supporting material such as a sheet of polymeric material, e.g. a polyester sheet or film, coated with a thin film of a conducting material, e.g. a metal such as aluminium, in the form of a drum or a continuous belt.

The CGL may comprise the dibromoanthanthrone alone preferably in the form of a layer deposited on the substrate, or the dibromoanthanthrone may be dispersed in a resin and formed into a layer on the substrate. Examples of suitable resins for use in the charge generating phase are polycarbonate, polyester, polystyrene, polyurethane, epoxy, acrylic, styrene-acrylic, melamine and silicone resins. Where the resin does not have good adhesive properties with respect to the substrate, e.g. a polycarbonate resin, adhesion between the resin and the substrate may be improved by the use of an adhesive resin. Specific examples of suitable resins for use in the charge generating phase are LEXAN 141 Natural (available from General Electric Plastics, Europe) and Styrene-Acrylate Resin E048 (available from Synres Nederland BV). A suitable adhesive resin for bonding the charge generating phase to the substrate is VMCA (available from Union Carbide).

The CTL preferably comprises a layer of a resin containing a compound of Formula 1 and a compound of Formula 2 and preferably has a thickness from 1.0 microns ($\mu$) to 50$\mu$ and more preferably from 5.0$\mu$ to 30$\mu$. Examples of suitable resins for use in the charge transport phase include one or more of polycarbonate, polyester, polystyrene, polyurethane, epoxy, acrylic, styrene-acrylic, melamine and silicone resins.

The compounds of Formula 1 and 2 may be incorporated in the CTL and the OPC may be prepared using methods described in the prior art.

The invention is illustrated but not limited by the following Examples.

EXAMPLE 1

A solution of 1 g of VMCA in 50 ml of 1,2-dichloroethane is prepared with the aid of ultrasound. This solution is applied to an aluminium sheet using a No. 1 K bar and dried at 80° C. for 1 hour to give a coating of 0.1 micron.

A solution of 42.4 g of Lexan 141 polycarbonate in 450 ml of 1,2-dichloroethane is prepared by refluxing for 3 hours. The solution is cooled, filtered through a sinter and made up to 607.6 g with 1,2-dichloroethane. 6.45 g of this solution, 0.45 g of dibromoanthanthrone, 6.05 g of 1,2-dichloroethane and 25 g of 3 mm glass beads are placed in a 2 oz WNSC bottle, sealed with MELINEX film and shaken for 1 hour on a Red Devil shaker. This dispersion is then applied to the first coating using a No. 5 K bar and dried at 80° C. for 1 hour to give a second coating of 3 microns.

A solution of 1.5 g of charge transport compound in 21.5 g of the Lexan 141 solution is then applied to the second coating using a No. 8 K bar and dried at 80° C. for 3 hours.

TESTING METHOD

The OPC device so obtained is tested using a Kawaguchi Electric Works Model SP428 Electrostatic Paper Analyser, in the dynamic mode. The surface voltage after charging for 10 seconds is measured, followed by the % dark decay after 5 seconds. The sensitivity in lux-sec is the light energy (intensity×time) required to reduce the surface voltage to half of its initial value. The residual voltage is that voltage remaining after 10× the above light energy has fallen on the surface. The results obtained using a leuco triphenylmethane and/or hydrazone charge transport material are shown below.

| Test Conditions | |
|---|---|
| Corona Voltage | −6 kV |
| Light Intensity (effective) | 5 lux |
| Temperature | 24.5° C. |

-continued

| Relative Humidity | | | 39.5% | |
|---|---|---|---|---|
| Test Results | | | | |
| CTM | Surface Voltage | % Dark Decay | Sensitivity lux-sec | Residual Voltage |
| 100% LTPM | 890 | 16.9 | 7.5 | 20 |
| 90% LTPM 10% Hyd. | 1160 | 25.0 | 6.5 | 20 |
| 80% LTPM 20% Hyd. | 1100 | 27.3 | 6.5 | 20 |
| 70% LTPM 30% Hyd. | 1030 | 30.1 | 5.75 | 20 |
| 60% LTPM 40% Hyd. | 1000 | 31.0 | 5.0 | 20 |
| 50% LTPM 50% Hyd. | 900 | 35.5 | 4.75 | 10 |
| 40% LTPM 60% Hyd. | 840 | 33.3 | 4.5 | 10 |
| 30% LTPM 70% Hyd. | 820 | 37.8 | 4.0 | 10 |
| 20% LTPM 80% Hyd. | 760 | 39.5 | 3.5 | 10 |
| 10% LTPM 90% Hyd. | 720 | 41.7 | 3.0 | 10 |
| 100% Hyd. | 630 | 47.6 | 2.5 | 0 |

The leucotriphenylmethane used in this Example has the formula:

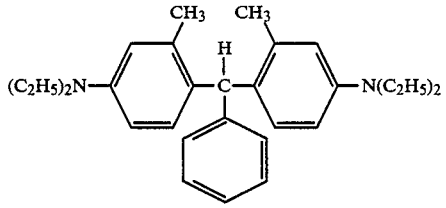

The hydrazone used in this Example has the formula:

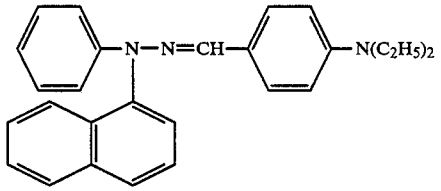

The Example shows that any combination of the LTPM and the hydrazone is better than either alone. The ideal OPC has high CA, low DD and residual potential and high sensitivity (this equates to a low numerical lux-sec figure). In general, there is a "trade-off" between high sensitivity on the one hand and high charge acceptance and low dark decay on the other hand because the former needs high photoconductivity and the latter low conductivity. What is most surprising is that additions of up to 50% of the hydrazone, which alone has the poorest CA, increases the CA figure of the LTPM. In addition, the important parameter of sensitivity also improves. This synergy is totally unexpected and very useful.

EXAMPLE 2

When the leucotriphenylmethane used in Example 1 is replaced by the leucotriphenylurethane of the formula:

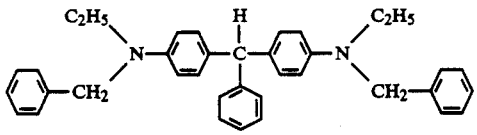

the results obtained are similar to those described in Example 1.

EXAMPLE 3

When the hydrazone used in Example 1 is replaced by the hydrazone of the formula:

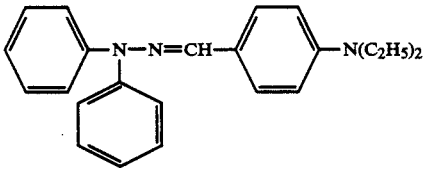

the results obtained are similar to those described in Example 1.

We claim:

1. An organic photoconductor comprising an electrically conducting support, a charge generation layer containing dibromoanthanthrone and a charge transport layer containing a di- or triarylmethane compound of the formula:

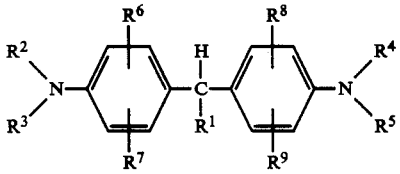

(1)

wherein $R^1$ is hydrogen or an optionally substituted alkyl, alkenyl, cycloalkyl, cycloalkenyl, aralkyl or aryl radical;

each of $R^2$, $R^3$, $R^4$ and $R^5$, independently, is hydrogen or an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, is a hydrogen or halogen atom or a hydroxy, alkyl or alkoxy group;

and a hydrazone compound of the formula:

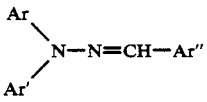

(2)

wherein each of Ar, Ar′ and Ar″, independently is a phenyl or naphthyl radical, each of which may optionally carry one or more non-ionic substituents.

2. An organic photoconductor according to claim 1 wherein, in the compound of Formula 1, $R^1$ is phenyl, each of $R^2$–$R^5$ is ethyl, each of $R^6$ and $R^8$ is methyl and is ortho to the central carbon atom and each of $R^7$ and $R^9$ is hydrogen.

3. An organic photoconductor according to claim 1 wherein, in the compound of Formula 2, Ar is phenyl, Ar′ is phenyl or 1- or 2-naphthyl and Ar″ is either 1- or 2-naphthyl or a 4-aminophenyl radical wherein the amino group is a tertiary amino group having alkyl, aralkyl or aryl substituents.

4. An organic photoconductor according to claim 1 wherein the charge transport layer contains a mixture of from 50 to 95% by weight of compound of Formula 1 and from 50 to 5% by weight of compound of Formula 2.

* * * * *